US005403233A

United States Patent [19]

Daneshvar

[11] Patent Number: 5,403,233

[45] Date of Patent: Apr. 4, 1995

[54] HUMIDIFIER

[76] Inventor: Yousef Daneshvar, 21459 Woodfarm, Northville, Mich. 48167

[21] Appl. No.: 21,170

[22] Filed: Feb. 22, 1993

[51] Int. Cl.[6] ..... F24F 6/04

[52] U.S. Cl. ..... 454/291; 237/78 R

[58] Field of Search ..... 237/78 R, 78 A, 78 B; 454/291, 328, 337

[56] References Cited

U.S. PATENT DOCUMENTS

| | | | |
|---|---|---|---|
| 1,250,280 | 12/1917 | Carpenter | 454/328 X |
| 1,428,150 | 9/1922 | Deleamont | 237/78 B |
| 1,910,232 | 5/1933 | Bender | 454/328 |
| 2,138,709 | 11/1938 | Rainbolt | 454/291 |

FOREIGN PATENT DOCUMENTS

| | | | |
|---|---|---|---|
| 614904 | 8/1937 | Germany | 454/337 |
| 119409 | 3/1927 | Switzerland | 237/78 R |

*Primary Examiner*—Harold Joyce

[57] ABSTRACT

A humidifier is constructed from basic units that have a rigid part supporting a hydrophilic part. A lower portion of a basic unit is disposed in a water-filled canal, and the upper portion is exposed to air, especially heated air from a heater. One embodiment is adapted for placement over a floor outlet for heated air to evaporate water from the canal into the heated air to increase the humidity thereof. This embodiment may be above or just below floor level. Various forms of covers are associated with the units.

19 Claims, 7 Drawing Sheets

HUMIDIFIER

THE BACKGROUND

This invention primarily is to be used for humidification of the areas and it is made due to a need for such function during the cold weather with heavy use of heaters. As a person living in Michigan for some time, and practicing as a physician as well, I had the opportunity to get familiar and aware of the problems due to loss of humidity because of the cold and use of heaters; the dry air affected me and many other people many ways. This causes dry skin, dry nose and nasal mucousa and then an effect on the facial sinuses and respiratory problems. To correct this I tried the portable humidifiers but I was not satisfied; they do not act natural, are expensive and make noise, it gets quite expensive to be placed in every room, and they do not function in concert with the heaters. The central humidifiers supposed to solve the problem however they do not work all the time and break, like the one we have, and their price, and repair are prohibitive. Furthermore they can not be bought and installed easily. And can not rescue a person if the need is immediate. These factors stimulated my mind to find a simpler and better solution and best humidifier is the product of this thought, and I believe will serve the purpose.

BRIEF SUMMARY OF INVENTION

The humidifier is a humidifying unit which is basically made from a natural or synthetic hydrophylic material that absorbs and holds the water due to its structure, and so it allows the water to be evaporated when exposed to dry air and air motion. The basic unit will consist of a hydrophylic material which will cover or go around a core made of plastic or metal that could give it a shape and the skeleton desired. The basic unit will be also used to cover different shapes of plastic or metal, ceramic or other hard materials, to make a device to allow the air to go through the moistured surface of it.

In simplest form this basic unit will be made from a straight core of hard materials: plastic, metal, ceramic, and/or their combinations that will hold the hydrophylic material around itself and to let it be held in desired shapes. This basic unit will hold the water and expose it to motion of air in different conditions. One prototype mentioned here will be made in a shape of a net or screen that will be exposed to air and specially moving air.

When this unit is exposed to the circulation of the air, specially when it is blown by different ways, it will allow evaporation of the water to occur and to provide many microscopic particles of water to move in the air and naturally to decrease and eliminate the lack of humidity. My experiment has shown that the particles of blown water can not be visualized by human eyes, and this is an indication that they turn to very small microscopic units.

This basic unit can be made in different shapes to serve and fit the need for the jobs it is desired to do; it can be made like a screen to be placed on the openings of the heaters, or be made in shapes such as trees, and flowers, special desirable likeable miniatures such as wind mills, small house shapes, or historic and religious building shapes etc. And it can have a fan to blow the water away and cause humidification.

DETAILED DESCRIPTION OF DRAWINGS

Figure 1:
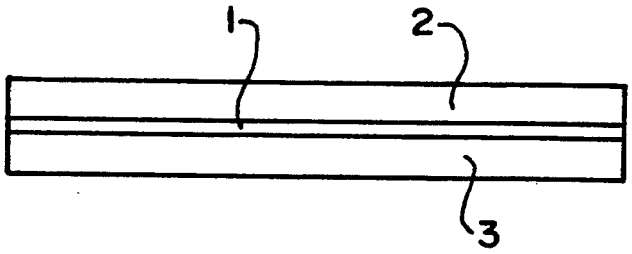
FIG. 1 is a top view of a basic unit.
Figure 2:
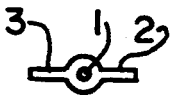
FIG. 2 is an end view of FIG. 1.
Figure 3:
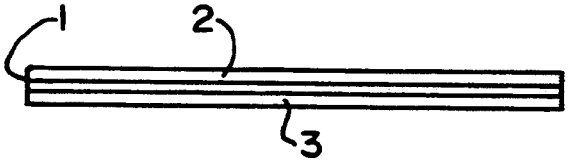
FIG. 3 is a front view of FIG. 1.

The basic Humi unit shown in FIGS. 1–3 consists of a central core with a hydrophylic materials around it. The function of the central core is to provide shape and in some models the supply of water and the materials around it are to absorb water and to allow evaporation to occur. In these FIGS., the central core is shown by 1 in the center and the hydrophylic material in the sides no 2 & 3.

Figure 4:
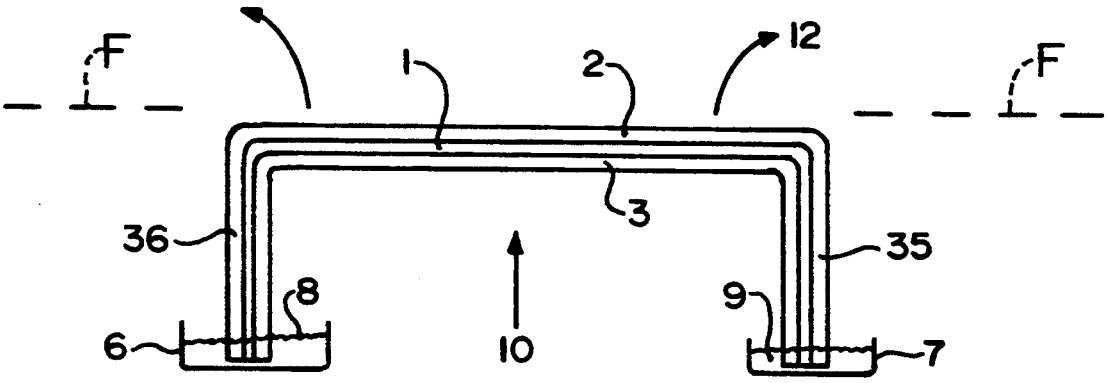
FIG. 4 is a front elevation view of a unit that has been shaped and put in use.

FIG. 4 shows the unit made from combinations of units shown in previous figures. In this view again the central core is shown in the center by 1 and the hydrophylic material around the central core by 2 and 3. However in this figure a shape is made from bending the ends of this unit and inserting the end pieces 35 and 36 inside a canal 6 and 7 that holds the water shown by 8 & 9. In this view the arrow 10 shows the direction of the air flow which will blow from the bottom when this unit is in place on the top of the opening of the heater and then the arrows 11 & 12 show the directions which the humidified air will move afterward. A flap or a piece of plastic may be used to direct the air flow in special way.

Figure 5:
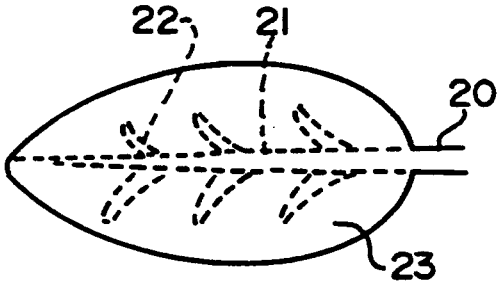
FIG. 5 is another embodiment of unit in the form of a leaf.
Figure 6:
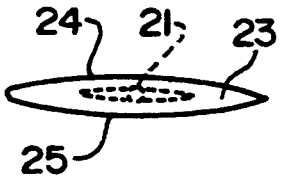
FIG. 6 is an end view of FIG. 5.

FIGS. 5 and 6 show a humidifying unit similar to unit which is like a leaf and is made of a central core with hydrophylic materials around it. The function of the central core is again to provide shape and allow it to be kept in place and also may supply the water and distribute it. The central core may be made from a hydrophylic mesh that will let the water to be distributed. The surrounding hydrophylic material will be supported by the central core and it will absorb the water to allow evaporation to occur. The beginning of the central core 21 which is like a stem is shown by 20 and the small branches from this central core are shown by 22, the hydrophylic material by 23, the top of the leaf by 24, and the bottom by 25.

Figure 7:
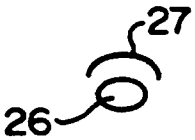
FIG. 7 is an end view of a unit covered by a cover.
Figure 8:
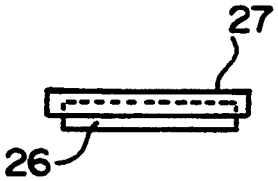
FIG. 8 is a front view of FIG. 7.

FIGS. 7 and 8 show a unit 26 which is covered by the cover 27. This shows how the air can swing and go from sides of the cover to the room. Importantly this cover may be directed differently to allow the air to move in special direction.

Figure 9:
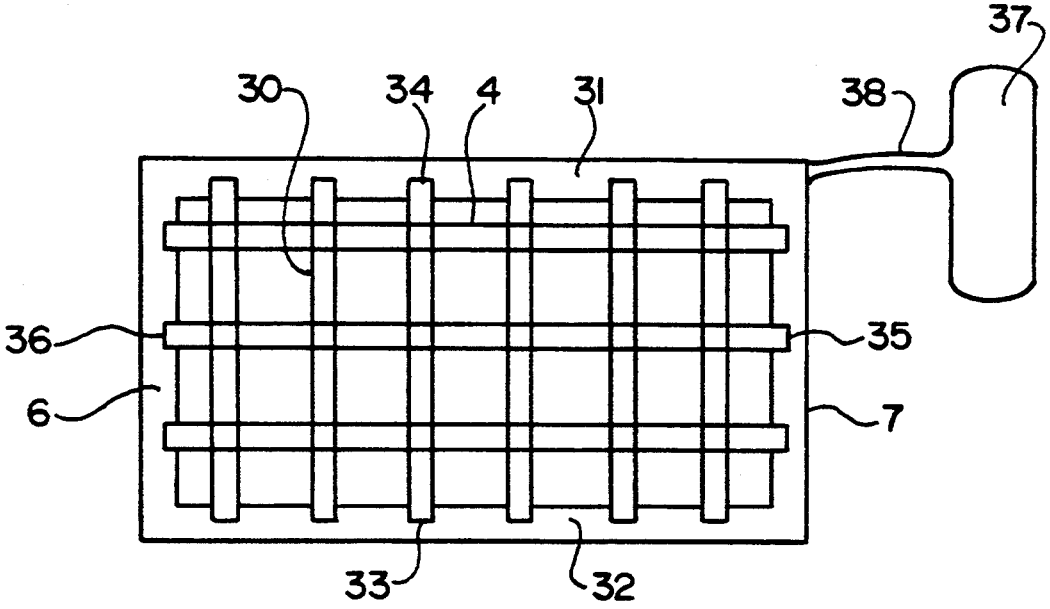
FIG. 9 is a top view of a humidifier constructed from many units.
Figure 10:
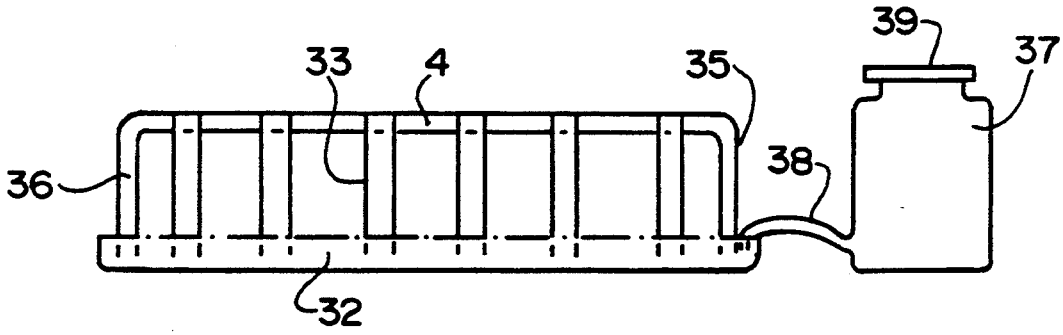
FIG. 10 is a front elevation view of FIG. 9.

FIGS. 9 and 10 show a best humidifier that is made from combinations of many units that has made the central body of this unit which looks like a screen from the top. The ends of the Humi units are bent and placed inside a canal 31, 32, 6, 7 that will hold water. The water comes by a narrow tube 38 from a container 37 having an opening 39. This unit will be placed on the top of the opening of the heaters. The lengthwise extending units are represented by 4 with bent ends 35, 36 extending into the canal at 7 and 6, and the widthwise extending units are represented by 30 with bent ends 33, 34 extending into the canal at 32 and 31.

Figure 11:
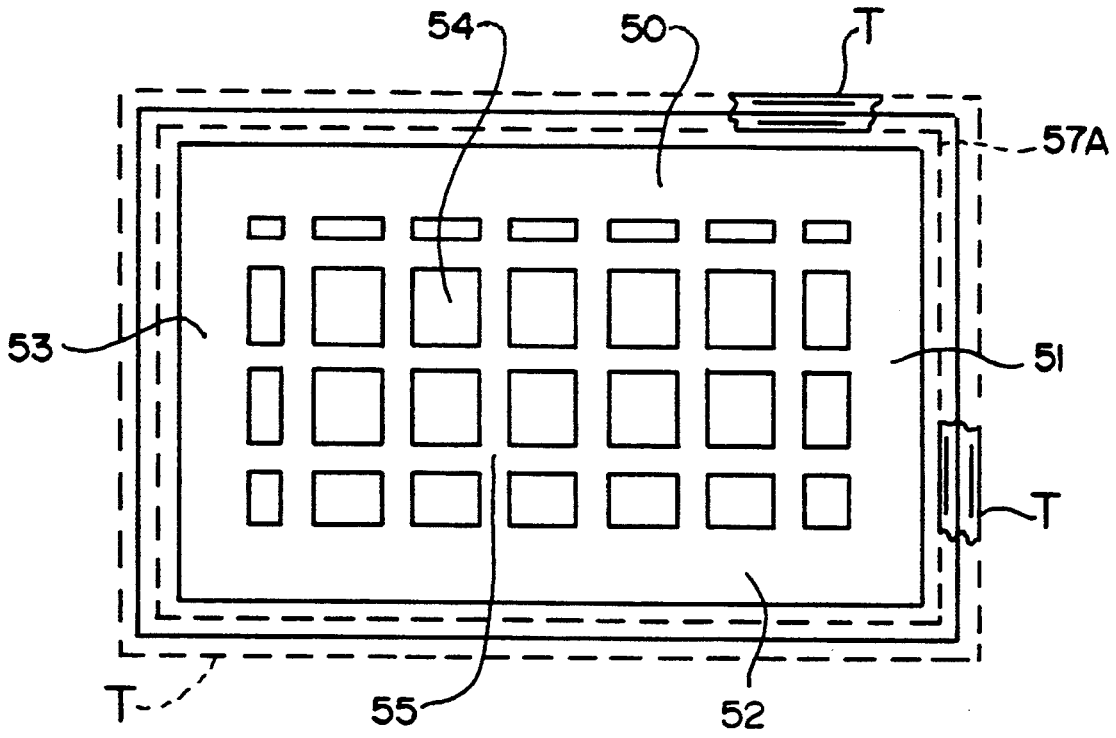
FIG. 11 is a top view of a cover that can be used with the humidifier.
Figure 12:
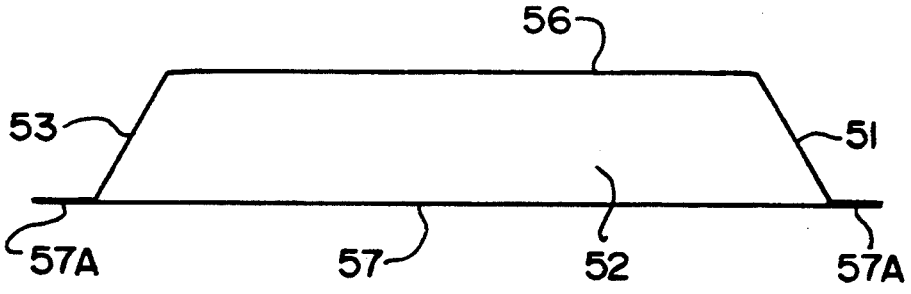
FIG. 12 is front elevation view of FIG. 11.

FIGS. 11 and 12 show a cover for the best humidifier that is made from a hard material such as plastic or metal. This cover will match the size of the screen of the humidifier which it is supposed to cover. And at the time of use will be placed on it. The sides of this cover are shown by no 50, 51, 52, and 53. The intersection of the lengthwise and widthwise extending solid portions of the top 56 are represented by 55 and the openings by 54. So in general this kind of cover will be placed on a unit similar to one shown in previous FIGS. 9 & 10. The air will go through openings such as 54. With simple modification the lines of this unit may be made to turn directionaly to direct the flow of the air in certain way.

The slope of the sides of this unit comes to blend with the surface of the carpet. In practice this slope will be made to be slow and the ends of the unit may continue with a flat piece such as 57A extending from the bottom 57 on the ground to be taped by tape T on the carpet and to decrease the chance of the toes hitting it.

Figure 13:
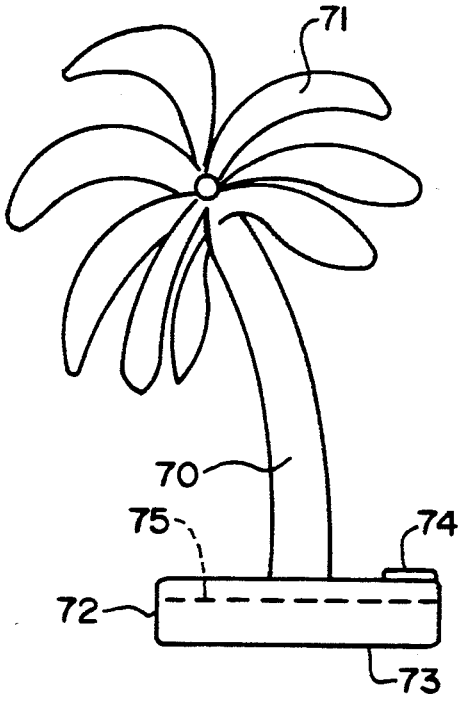
FIG. 13 is a front elevation view of another embodiment of humidifier.

FIG. 13 shows the from view of a humidifier that has the shape of a palm tree. The base of this unit will function as the container of the water and the stock will carry the water to the top and the leaves to allow evaporation to occur. In this view the 70 is the stock, 71 is one leaf, 72 is the container of the water as well as the base, 73 is the bottom of the unit, 75 shows the level of water and 74 is the opening of the container.

Figure 13A:
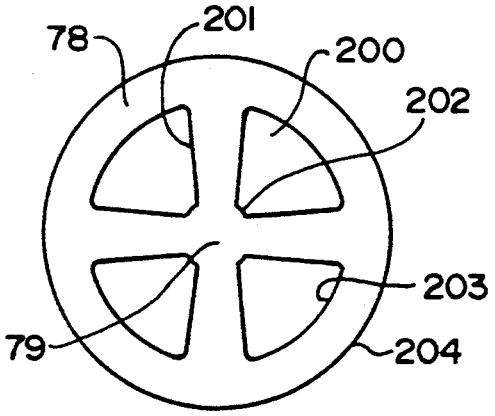
FIG. 13A is a top view of the base of a humidifier similar to that of FIG. 13.

FIG. 13A shows the top of the base of a humidifier similar to one shown in previous FIG. 13. This shows a base that has a canal system with opening in its center so that this can be placed on a place that the air is coming from the bottom to be blown to the leaves. In this figure the border of the base is shown by 204 the center place for the stem of the unit by 79 and the opening of the base by 200, the wall around the stem by 202, the wall of the canal going from the center to the periphery by 201.

Figure 13B:
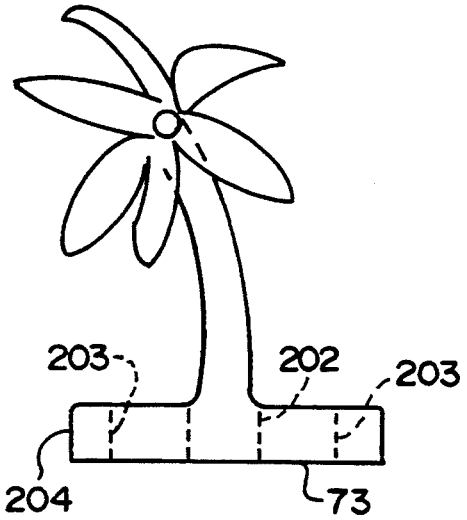
FIG. 13B is a side elevation view of a humidifier using the base of FIG. 13A.

FIG. 13B shows the side view of a base similar to one shown in previous FIG. 13A. This view shows the base of the container by 73. The border of the base is shown by 204, and the border of the open place by 203 in the periphery and 202 around the stem.

Figure 14:
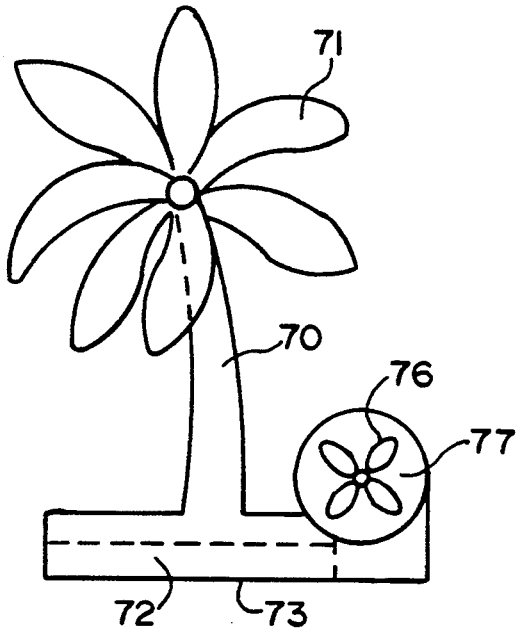
FIG. 14 is a view similar to FIG. 13 showing a modification.

FIG 14 is basically the same as one shown in previous fig except it shows a fan that can be directed to blow the air toward the leaves and increase the speed of evaporation. In this view the fan is shown by 76 and its place by 77.

Figure 15:
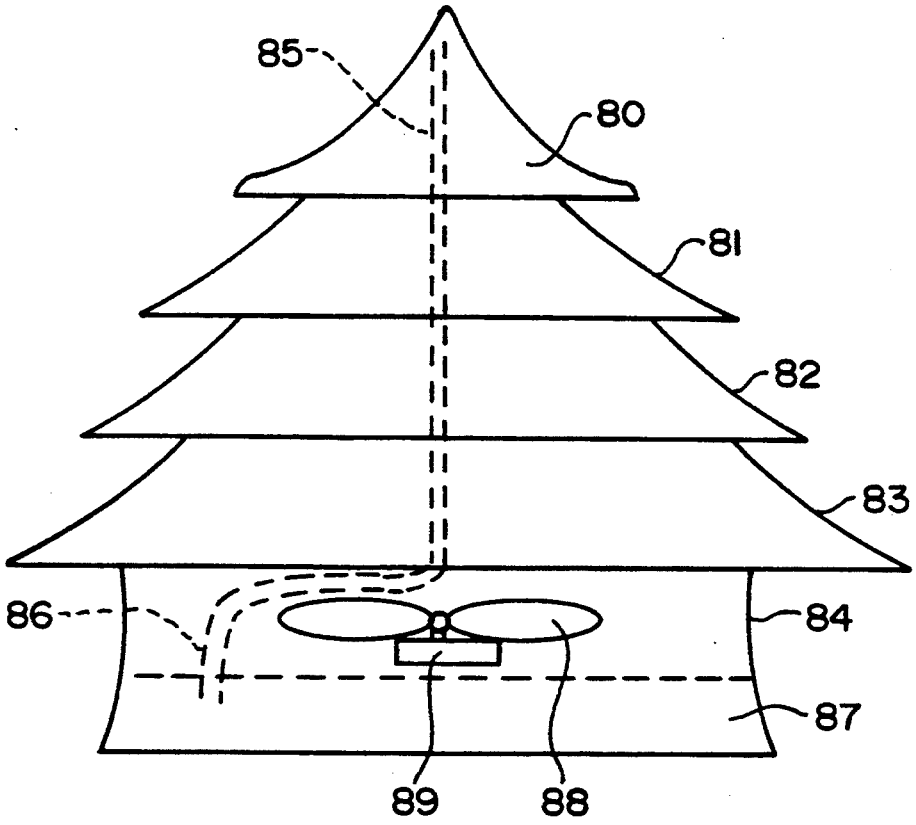
FIG. 15 is a front elevation view of still another embodiment of humidifier.

FIG. 15 shows the from view of a humidifier that is in shape of a Buddhists temple. The base of this unit will function as the container of the water that will be carried to the top by a tube; the water will move down by way of capillary permeability as well as due to hydrostatic pressure. Then the distribution will occur and allow evaporation to happen. In some models the top one or two compartments 80 and 81 may be used to have a container in their body and the very top surface to act like a cap so that it could be removed to allow the water to be poured. A fan will be also placed in the base to allow the air to be blown as directed. In this view the 80, 81, 82, and 83 are the sides of this unit made from plastic parts or hydrophylic material, or their combinations. The 85 is the tube, the 84 is the body of the unit, the 86 shows the continuation of the tube. The 87 shows the water, 89 is the electric engine, and the 88 is the fan. In front of the base or in the surface of one of the sides a plaque of magnet may be placed to allow sticking of a clock or nice wording such as religious words, greetings such as happy birthday, I love you Mom etc.

Figure 16:
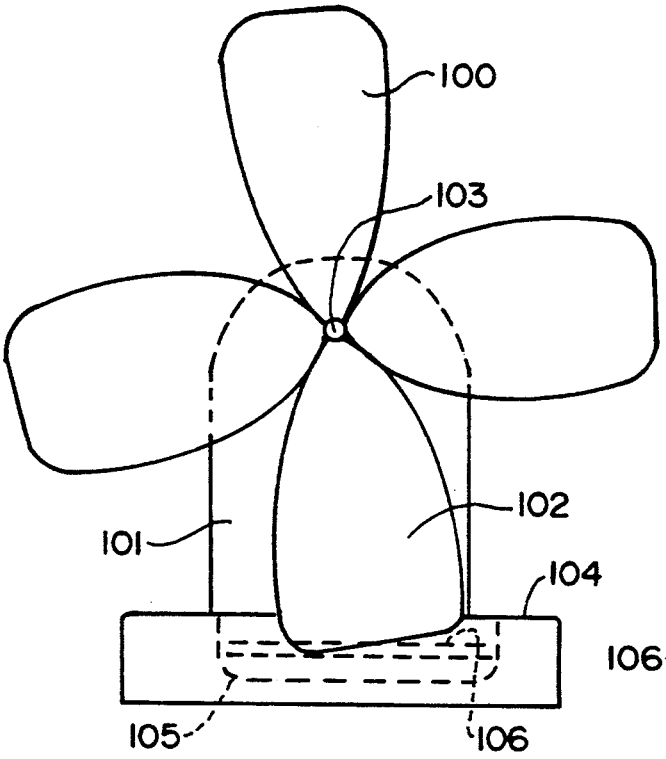
FIG. 16 is a front elevation view of still another embodiment of humidifier.
Figure 17:
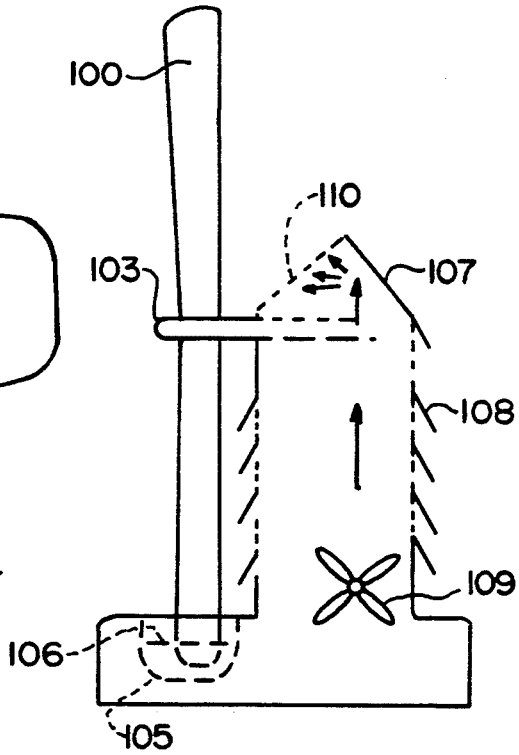
FIG. 17 is a side elevation view of FIG. 16.

FIG. 16 shows the front view of a humidifier that is in shape of a Wind Mill. In this case the body that contains humi units will have a shape such as shape of the body of a wind mill and with wings that are placed and rotated by an electrical engine. These wings will come and their tip to go through a small basin 105 of water in front of the units body 101, and to continue to rotate so that after several rotations they will be saturated with water, these wings and body of the unit to be exposed to the moving air provided by an electric fan 109 and directed to blow the air thorough the openings of the body 110 and the wings of the unit to cause evaporation to occur. The speed of motion and the fan can be adjusted by a controller to allow the level of humidification to be controlled. A small light with its own off & on switch may be utilized to allow the unit to function as a night light and a photo electric cell may be added to make the light to turn on only at night.

A clock may be added to allow it to be used in different ways. Alternatively and importantly a magnet or a flat iron may be placed on the surface of the base in front of the pond to allow different greetings and wordings such as religious wording, or such as Happy Birthday, I love you Mom etc to be placed.

In this view the body of the unit is shown by 101, the base by 104, the level of water by 106, the wings by 100 & 102 the central axle of the wings by 103. And the basin by 105.

The fan 109 blows the air in direction of large arrows; then it hits the flat surface of 107 to disperse and go through opening 110 to hit the fan 100. The sides of the body show their hydrophylic walls of 108 that will function in their own part as the humidifier parts when some of the moving air goes through them. The side walls may be chosen to be closed to prevent the air to go in that direction.

THE DETAILED EXPLANATIONS OF THE INVENTION

The cold weather has its own nice things, it is refreshing many times and brings the snow with it. However it has its own problems as well, one of them is due to lack of the humidity which is bothersome in many ways it causes dry skin, dry nose and mucosa and probably it has something also to do with sinus and respiratory problems, which commonly occurs in winter when many houses have dry air due to use of central heaters. The present available techniques to fight this problems are not the best in my mind. In my experience the portable humidifiers are not the best answer and I was not satisfied with them, they are expensive, occupy good space, have their bothersome noises. Their shape is not what many people like to see in their living room etc. Their price is high so their use in every room gets quite expensive, they do not function in concert with the central heaters as well, they have to be plugged to the electricity and to be turned on and off, and are subject to problems of electrically operated motors. The central humidifiers are supposed to solve the problem, however they do not work all the time and break, like the one that we have and their price, and cost of repair and replacement are prohibitive, and not every one can afford them, they need special people to install them and in urgent cases they are not an answer, since can not be purchased and used. These factors stimulated my mind to find a simpler and better solution and the humidifier is the product of such thoughts. The unit is basically made from a hydrophylic material such as cotton or similar porous natural or synthetic material that absorbs and holds the water due to it's own nature and structure, and then to allow it to be evaporated when exposed to dry air and air motion. This basic unit will be made to be held in place and to cover a core made of plastic or metal that will give a shape and the skeleton to this unit. The basic hydrophylic material may be used to cover different shapes of plastics, metal, ceramic or other hard materials, to make a device to allow the air to go through it. The units may have different shapes such as follows:

a. a tubular or a cylindrical shape which in this case the core will be in the center surrounded by hydrophylic material. Such as sugar cotton around a stick. The core may supply the water from inside as well.
b. a band of hydrophylic material like a flat rectangular prism that has a core to give and hold it in shape. The core may also provide the water as well.
c. a shingles shape of hydrophylic material that will have a core to give shape and hold it in shape as needed. The core may provide the water as well.
d. a larger bands or walls made from hydrophylic material to have a core to give a shape and hold the unit as needed and also may provide the water as well.

Alternatively a porous material made from plastic or ceramic may be used to carry and hold the water and allow evaporation to occur. Or plastic or synthetic material may be used to make the hydrophylic material. So any natural or synthetic materials that can act as hydrophylic material to absorb the water and allow the evaporation to occur can be used to make such a unit. When the cotton is used as hydrophylic material, it can be shaped to be like a light fabric to have more narrow space and air spaces in between its fibers to allow better hydrophylic function to occur and evaporation to happen and the air to go thorough it with less resistance. This basic material can be colored in many ways to make desired units for the system we want to use. It's thickness may also vary, and the thickness in a given unit may also vary as well. The support unit may go around it if desired rather than going through it.

This unit will absorb water from a source and let it to spread and diffuse in its length due to its nature and capillary permeability, and then when exposed to the dry air or the moving air in different conditions will allow the evaporation to occur, and humidity to be provided in a nice fashion. In my experience the water will evaporate by this unit without being seen. And the fact that the particles can not be seen by human eyes is an indication that they turn to very small microscopic units which are advantageous. The plasticity and adaptiveness of this basic unit will allow it to be made in different shapes for different purposes. One prototype mentioned here will be made in shape of a net or screen and a unit made from such screen will be placed inside or outside of the opening of a common air condition and heater openings for example, just below the floor level F shown in FIG. 4. The ends of the humi units will be placed inside a canal or similar place filled with water. This canal will go around and they may be manually filled with water or to be connected to a water supply that will provide a continuous draining of the water to this unit. Simple valves or other controls will be made to adjust the flow of the water to the canals. So in practice the hydrophylic parts of these screens can be connected to a water source and be saturated, in some cases the water may be poured or brought to them from the top side. When the hydrophylic material has absorbed the water and is saturated then it will allow the evaporation of the water to occur by using the following ways:

1. when the air is dry, the evaporation will automatically occur and continue.
2. When the heater is on and the fan blows then the motion of the air will cause the evaporation of the water to happen even more rapidly, and to be carried around the room. Therefore there will be a nice correlation between the duration of the function of the heaters and the amount of humidification, to make a nice balance between the use of the heater and the function of this humidifier, to work best.
3. a fan may be used to blow the air directionaly.

Importantly this unit can be placed outside (on top of) the opening of the heaters or it can be made with some modification to be easily placed inside the opening of the heaters below the surface of the carpet to avoid the person's foot to hit it.

The canal that holds the water can be connected by a soft plastic tube or hose to the water source that can be placed in a convenient place, away from the opening, or to be hidden.

Different units can be made with different shapes to expose the hydrophylic parts of such units to motion of the air blown by electrical fans. So this basic unit can be made in different shapes to serve and fit the need for the jobs it is desired to do. These units may be made to function:

a. they can be placed on places that the air is blowing for one reason or another (windows, fans etc).
b. to expose this unit to air which is blown by a fan or other blowing machines of different sizes designed and made for this purpose.

In order to make different little more complicated units, the basic units will be modified to have a structure similar to leaves of the plants and trees. In these units the water will come by a central stem to divide to smaller branches all with hydrophylic matrix inside or outside held in place with use of a hard component to give them shape and body. These then will be used in making more complicated and different shapes and units. The water container may be placed in the bottom to move up due to capillary function or it can be placed in the top or the water to be delivered to the top by a hose or tube to allow the water to drip from the top of that particular unit. Then with utilization of these basic ideas many different shapes and complicated forms may be made for a better use or simply for different models. The center core of the unit may also be made from a mesh, to carry the water in its length to deliver to the flat parts. So units can be made from combinations of such basic units to be in shape of trees, flowers, special buildings, or in shape of different important, ancient, historic or famous buildings etc. Inside these a light bulb may be placed to act as a night light, in this case a photocell may be added to conveniently turn the light on only at dark. In some cases a clock to be placed to function as a clock as well. All are to make it more attractive and the user to enjoy from it. A small plaque of magnet will allow very easy placement of small things such as digital clocks or bands of greetings such as I love you mom, happy birthday etc which can be changed from day to day and time to time. This will allow a flower stem to be attached as well as many other things.

One prototype of such unit will be made to be shaped like a Palm tree, it will have leaves to allow the water to vapor. This will have a base that has water and can be filled easily. The base will be shaped appropriately with opening to be placed on the opening of the heaters or close to a moving air. Or alternatively and importantly the base to be closed and to have a smaller fan incorporated in its base or side to blow the air in the directions which is desired. So the direction can be adjusted with use of simple techniques.

Units for the opening of the heaters: This unit will be shaped like a screen and to have a size to sit on the opening of the heaters. The tip of each line that makes this screen will be placed inside narrow canals that has water that are connected to each other around the base. The immersion of the tips of each of the lines of screens inside the water will allow their body to absorb the water and to take it into their system, and to expose it to the moving air from the heater. In order to prevent the dust and other floating dirts of the air to sit on top of these screens these units will be covered by a matching cover or roof made of thin plastic or metal, or similar material. This piece can be removably placed on the units top.

The water will be delivered to this unit and other units here by utilizing different methods:

1. In simplest cases the water will be poured into the canals or a supply place connected to the canals, by small tubes.
2. A container may be used close to the unit or it may be located in proper or desired place in hiding, and the water to come by small plastic tube. This is to allow the container to be out of the way of the person, not to cause problems such hitting the foot to the corners to occur.
3. In the other models that will be mentioned later the water may be delivered in some units from the top to their needed place. This can be done either by having a container of the water placed on the top of the unit or to be delivered by a tube.

Importantly to avoid having a unit to stand above the floor, that can be prohibitive in certain cases, and cause fear of hitting foot against the edges of the unit, then this unit for the openings of the heaters will be made to sit and be placed inside the opening of central air conditioning or heating on the ground. In such cases the canals will be located lower than the carpet level and the tips of the screen will be placed inside them and the cover of them will cover the opening of the heaters. The water will be delivered to the canals by slow draining system with a control. The outside of such units will have a look similar to cover of the opening of the central heating.

The unit which is to be placed above the ground will have a protective plastic cover, however the sides of this protective plastic cover are to be shaped to taper down and to come and touch the floor in a flat downhill way so that finally to blend with the surface of the floor in order to prevent the unit to stay sharply elevated above the ground and to cause the toes to hit it. Also importantly the blades of this cover can be made to be rotated in order to allow the air to be directed in a special direction.

Other humidifying units may be made while utilizing different units with different shapes to satisfy different peoples choices, wishes, desire and preferences. These can be then made in shapes such as different flowers, trees (Christmas tree, Palm tree etc.) or a shape such as wind mills, or in shape of some ancient, historic or religious buildings etc. such as shape of Mecca for the Moslems and shape of St Petersburg cathedral for Christians or Buddhist temple for Buddhists etc. It may be also made in shape of pyramids of Egypt for the people who enjoy them.

In the cases and circumstances when the air is not moving enough then the circulation of air may be provided or enhanced with use of a fan. In such cases this will be a small electric fan that will provide a controlled and directional motion of the air to occur and go through the spaces among the leaves or lines or bands of water containing units designed and specially spaced for these units.

In some of these units a small electric pump may be utilized to function to move the water from the bottom reservoir to the top when it is needed. This can be programed to move the water periodically to have the water supplied to the top of the units. For example the engine can be utilized to function when the level of the water in the reservoir or basin reaches certain level, something similar to the basement pumps.

A particular shape that will be explained here is a unit in shape of Wind Mill=Mollain Rouge. In this case the body that contains humi units will have a shape such as shape of the body of a wind mill and with wings that are placed and rotated slowly by an electrical engine. These wings come and have their tip to go through a small basin of water in front of the units body, and to continue to rotate so that after several rotations they will be saturated with water, these wings and body of the unit to be exposed to the moving air provided by an electric fan and directed to blow the air thorough the openings of the body and the wings of the unit to cause evaporation to occur. The speed of the rotation of the wings and the fan can be controlled to allow the level of humidification to be controlled. A small light with its own off & on switch may be utilized to allow the unit to function as a night light and a photo electric cell may be added to turn on at dark only.

A clock may be added to allow it to be used in different ways. Alternatively and importantly a magnet or a flat iron may be placed on the surface of the base in front of the pond to allow different greetings and wordings such as religious wording, or such as Happy Birthday, I love you Mom etc to be attached on it when they have a rear piece made from iron piece that sticks to the magnet.

Many other shapes and configurations may also be made from the utilizations of the same basic ideas to make humidifying units that are likeable and enjoyable and portable, and also to respect the values and interest of different groups of people, for example one to be made in shape of the Buddhist temple. In this case a unit will be made with combinations of different shape units to create a miniature of a building that would be similar to the outlook of the Buddhist Temples.

The base of this unit will function as the container of the water that will be carried to the top by a tube, and the water will move down by way of capillary permeability as well as due to hydrostatic pressure. And then the distribution will occur and allow evaporation to happen. In some models the top one or two top compartments such as 80 and 81 in FIG. 15 may be used to have a container in their body and the very top surface to act like a cap so that it could be removed to allow the water to be poured. In front of the base or in the surface of one of the sides a plaque of magnet may be placed to allow sticking of a clock or nice wording to be sticked. Such as religious words, greetings such as happy birthday, I love you Mom etc. The top surface of this unit may have a plastic cover to prevent dust accumulation on it. The tube which carries the water may have branches in between to supply the water and it's center may have the mesh of hydrophylic material to slow the flow of water and to allow distribution all along. A small light with its own off & on switch may be utilized to allow the unit to function as a night light and a photo electric cell may be added to unit to turn on at dark only.

Other model such as The shape of Mecca will be made to allow the Moslems to enjoy seeing their respected place. The model will have the basic constructions and parts as mentioned to the Buddhist's temple. Some parts of this unit may be made from plastic to give shape to the unit and the fan will be located in the bottom, where the water will be located as well. Other shapes such as the Vatican or the ST Petersburg Cathedral will be used to allow the Christians to see humidification provided from a place that they like to see. Other shapes such as ships and locomotives and airplanes may also be made.

So importantly the body and walls of these units may be made from combinations of hard materials such as plastic as well as hydrophylic materials so that the mixture gives the desired shape as well as the needed humidifying function. At some parts of these units the hydrophylic materials may be made in a shape that they could be moved and tilted or directed in a way that the outcome of humidification and its degree and directions could be changed and adjusted. Some levers or knobs may be used for such purpose.

Similarly the other shapes and configurations will be chosen to make this unit to be likeable and enjoyable as well. And again a clock may be added to many of those units and a light and photocell may be also utilized in certain models to allow the unit to be more useable. An electrical programer may also be utilized to make the unit to work on certain times of the day or night.

The Palm tree mentioned will be made from Humi Unit in the shape of a palm tree with a stem sitting inside a water supply or container. The stem or stock of this unit will be made from hydrophylic mesh to carry the water to the leaves, and its leaves will be shaped to stand in natural fashion. The container of the water may be made from combinations of canals with open spaces in between them to allow the air to go thorough. This unit may be placed on places that the air comes from bottom such as opening of the heaters to allow humidification to occur. In other models an electric fan will be placed in its base to allow the air to move directionaly and the evaporation to increase.

Naturally the size and relative sizes of the components of the units, their shapes and coloring may change to satisfy different people and overcome technical problems as well.

I claim:

1. A humidifier for humidifying a room air space comprising:

receptacle means for holding water that is to be evaporated to humidify such a room air space;

water absorbent means for absorbing water from said receptacle means and evaporating it to such a room air space;

said water absorbent means comprising a first portion inserted into said receptacle means for absorbing water and a second portion outside of said receptacle means for evaporating water to humidify such room air space; and means for directing air to move across said second portion of said water absorbent means to be humidified by the water evaporated by said second portion; in which, said water absorbent means is supported upright over said receptacle means and is also disposed over said means for directing air to move across said second portion of said water absorbent means, said means for directing air to move across said second portion of said water absorbent means comprises a floor outlet register that blows air upwardly across said second portion of said water absorbent means, said water absorbent means comprises a number of individual elongate elements spanning said floor outlet register and voids separating said elongate elements, said individual elongate elements are arranged to provide said second portion as a lattice that is disposed directly over said floor outlet register, and further including a cover comprising a lattice that is in overlying registry with said lattice of said second portion of said water absorbent means so that said cover's lattice covers said second portion's lattice and voids of one lattice register with those of the other lattice.

2. A humidifier for humidifying a room air space comprising:

receptacle means for holding water that is to be evaporated to humidify such a room air space;

water absorbent means for absorbing water from said receptacle means and evaporating it to such a room air space;

said water absorbent means comprising a first portion inserted into said receptacle means for absorbing water and a second portion outside of said receptacle means for evaporating water to humidify such room air space; and means for directing air to move across said second portion of said water absorbent means to be humidified by the water evaporated by said second portion; in which, said water absorbent means comprises a number of individual elongate elements each having a central core for providing the basic shape of the element and water absorbent media supported by said central core, said water absorbent media circumferentially enclosing said central core in both said first and second portions of said water absorbent means, and said elongate elements collectively forming both said first and second portions of said water absorbent means such that said first portion of said water absorbent means comprises a first section of each of said elongate elements containing a first section of said central core circumferentially enclosed by a first section of said water absorbent media and said second portion of said water absorbent means comprises a second section of each of said elongate elements containing a second section of said central core circumferentially enclosed by a second section of said water absorbent media.

3. A humidifier as set forth in claim 2 in which each of said elongate elements has an inverted U-shape, said first section of each of said elongate elements comprises end sections of the inverted U-shape, and said second section of each of said elongate elements comprises an intermediate section of the elongate element lying between said end sections.

4. A humidifier as set forth in claim 3 in which said elongate elements are arranged to provide said second portion of said water absorbent means as a lattice.

5. A humidifier as set forth in claim 2 further including cover means comprising a number of elongate cover elements each disposed in covering relation to said second section of a corresponding one of said elongate elements of said water absorbent means.

6. A humidifier as set forth in claim 2 in which said means for directing air to move across said second portion of said water absorbent means comprises a floor outlet register over which said second portion of said water absorbent means is disposed.

7. A humidifier as set forth in claim 6 in which said elongate elements are separated by voids through which air from said floor outlet register passes.

8. A humidifier as set forth in claim 7 further including cover means for covering said water absorbent means, said cover means comprising a number of individual cover elements separated by voids, each of said cover elements being in covering relation to said second section of a corresponding one of said elongate elements of said water absorbent means, said cover means comprising side wall means for supporting said cover elements, and said side wall means being inwardly sloped in the direction of air flow through the humidifier.

9. A humidifier as set forth in claim 8 in which said individual cover elements each has a concave shape in transverse cross section toward a covered one of said individual elongate elements of said water absorbent means.

10. A humidifier as set forth in claim 6 in which said second sections of said individual elongate elements span said floor outlet register and further including cover means, including voids, for covering said second sections, said cover means further comprising a side wall that is sloped inwardly in the direction of air flow through the humidifier.

11. A humidifier as set forth in claim 2 in which said second portion of said water absorbent means is disposed inside a floor outlet register so as not to protrude above said floor outlet register.

12. A humidifier as set forth in claim 8 in which said cover means comprises side wall means for supporting said cover elements, and said side wall means slopes inwardly in the direction of air flow through the humidifier.

13. A humidifier as set forth in claim 2 in which said water absorbent media comprises a central circumferentially bounding portion and ridges running lengthwise of each of said elongate elements and protruding radially outwardly from said central circumferentially bounding portion.

14. A humidifier as set forth in claim 2 further including a number of elongate cover elements each disposed in covering relation to said second section of a corresponding one of said elongate elements of said water absorbent means, and each comprising a shape that in transverse cross section is concave toward said second section of the corresponding elongate element of said water absorbent means.

15. A humidifier for humidifying a room air space comprising:

receptacle means for holding water that is to be evaporated to humidify such a room air space;

water absorbent means for absorbing water from said receptacle means and evaporating it to such a room air space;

said water absorbent means comprising a first portion inserted into said receptacle means for absorbing water and a second portion outside of said receptacle means for evaporating water to humidify such room air space; and means for directing air to move across said second portion of said water absorbent means to be humidified by the water evaporated by said second portion; in which, said water absorbent means comprises a number of individual elongate elements each having a central core for providing the basic shape of the element and water absorbent media supported by said central core, said central core of each of said elongate elements has an inverted U-shape whose ends are disposed in said receptacle means and said water absorbent means wicks water from said receptacle means to that portion of the elongate element lying between said ends of said central core, said elongate elements are arranged to provide said second portion of said water absorbent means as a lattice, and further including a cover comprising a lattice that is in overlying registry with said lattice of said second portion of said water absorbent means so that said cover's lattice covers said second portion's lattice and voids of one lattice register with those of the other lattice.

16. A humidifier for humidifying a room air space comprising:

receptacle means for holding water that is to be evaporated to humidify such a room air space;

water absorbent means for absorbing water from said receptacle means and evaporating it to such a room air space;

said water absorbent means comprising a first portion inserted into said receptacle means for absorbing water and a second portion outside of said receptacle means for evaporating water to humidify such room air space; and means for directing air to move across said second portion of said water absorbent means to be humidified by the water evaporated by said second portion;

in which said second portion of said water absorbent means is disposed to span a floor outlet register in a floor, and further including cover means disposed in covering relation to said second portion of said water absorbent means, said cover means comprising a side wall that is sloped inwardly in the direction of air flow through the humidifier and a flat part extending from the side wall adapted to be secured to the floor, and fastening means engaging said flat part for fastening said flat part to the floor.

17. A humidifier as set forth in claim 16 in which said side wall has a base from which it slopes inwardly in the direction of air flow through the humidifier, said flat part extends outwardly from said base, and said cover means comprises a number of individual cover elements separated by said voids spanning said side wall at a location on its inward slope that is spaced from said base.

18. A humidifier for humidifying a room air space comprising:

receptacle means for holding water that is to be evaporated to humidify such a room air space;

water absorbent means for absorbing water from said receptacle means and evaporating it to such a room air space;

said water absorbent means comprising a first portion inserted into said receptacle means for absorbing water and a second portion outside of said receptacle means for evaporating water to humidify such room air space; and means for directing air to move across said second portion of said water absorbent means to be humidified by the water evaporated by said second portion;

in which said second portion of said water absorbent means is disposed to span a floor outlet register in a floor, and further including cover means, including voids, disposed in covering relation to said second portion of said water absorbent means, said cover means comprising a side wall that is sloped inwardly in the direction of air flow through the humidifier and a flat part extending from the side wall adapted to be secured to the floor, in which said side wall has a base from which it slopes inwardly in the direction of air flow through the humidifier, said flat part extends outwardly from said base, and said cover means comprises a number of individual cover elements separated by said voids spanning said side wall at a location on its inward slope that is spaced from said base in which said water absorbent means comprises a number of individual elongate elements each having a central core for providing the basic shape of the element and water absorbent media supported by said central core, said water absorbent media circumferentially enclosing said central core in both said first and second portions of said water absorbent means, and said elongate elements collectively forming both said first and second portions of said water absorbent means such that said first portion of said water absorbent means comprises a first section of each of said elongate elements containing a first section of said central core circumferentially enclosed by a first section of said water absorbent media and said second portion of said water absorbent means comprises a second section of each of said elongate elements containing a second section of said central core circumferentially enclosed by a second section of said water absorbent media.

19. A humidifier for humidifying a room air space comprising:

receptacle means for holding water that is to be evaporated to humidify such a room air space;

water absorbent means for absorbing water from said receptacle means and evaporating it to such a room air space;

said water absorbent means comprising a number of individual elongate elements each having a first portion in said receptacle means for absorbing water and a second portion exposed to air for evaporating water that has been wicked from said first portion to thereby humidify such room air space; and means for directing air to move across said second portion of said water absorbent means to be humidified by the water evaporated by said second portion; in which, said water absorbent means comprises a number of individual elongate elements that wick water from said first portion to said second portion, said elongate elements are arranged to provide said second portion of said water absorbent means as a lattice, and further including a cover comprising a lattice that is in overlying registry with said lattice of said second portion of said water absorbent means so that said cover's lattice covers said second portion's lattice and voids of one lattice register with those of the other lattice.

* * * * *